US005620268A

United States Patent [19]

Yamaguchi et al.

[11] Patent Number: 5,620,268

[45] Date of Patent: Apr. 15, 1997

[54] COMPOSITE CASSETTE INCLUDING A TAPE CASSETTE AND A RIBBON CASSETTE

[75] Inventors: Koshiro Yamaguchi, Kasugai; Kiyoshi Sugimoto, Kuwana; Yutaka Sugiyama, Nagoya, all of Japan

[73] Assignee: Brother Kogyo Kabushiki Kaisha, Nagoya, Japan

[21] Appl. No.: 617,058

[22] Filed: Mar. 18, 1996

[30] Foreign Application Priority Data

| | | | |
|---|---|---|---|
| Mar. 29, 1995 | [JP] | Japan | 7-100064 |
| Nov. 30, 1995 | [JP] | Japan | 7-337942 |
| Jan. 9, 1996 | [JP] | Japan | 8-019437 |

[51] Int. Cl.[6] ..... B41J 11/58

[52] U.S. Cl. ..... 400/603; 400/207; 400/243

[58] Field of Search ..... 400/613, 207, 400/208, 242, 243

[56] References Cited

U.S. PATENT DOCUMENTS

| | | | |
|---|---|---|---|
| 5,188,469 | 2/1993 | Nagao et al. . | |
| 5,193,919 | 3/1993 | Godo et al. . | |
| 5,296,084 | 3/1994 | Hattori et al. | 400/613 |
| 5,302,034 | 4/1994 | Kitazawa | 400/613 |
| 5,374,132 | 12/1994 | Kimura | 400/613 |

FOREIGN PATENT DOCUMENTS

| | | |
|---|---|---|
| 1-136249 | 11/1989 | Japan . |
| 2-106555 | 4/1990 | Japan . |
| 3-74956 | 7/1991 | Japan . |

*Primary Examiner*—John S. Hilten
*Attorney, Agent, or Firm*—Oliff & Berridge

[57] ABSTRACT

A tape/ribbon composite cassette comprising a tape cassette freely detachably mounted in a printer provided with a print head, the tape cassette housing a tape serving as a print medium, the tape cassette having an upper surface; a ribbon cassette freely detachably mounted in the tape cassette, the ribbon cassette housing an ink ribbon, the ribbon cassette provided with an upper surface overlapping at least a portion of the upper surface of the tape cassette; at least two guide portions provided to the tape cassette at positions separated from each other at an outer periphery of the tape cassette, the at least two guide portions guiding the ribbon cassette vertically in and out of the tape cassette; and at least two guided portions formed integrally to the upper surface of the ribbon cassette at positions corresponding to the positions of the guide portions, the at least two guided portions engaging with the guide portions to guide the ribbon cassette vertically in an out of the tape cassette.

22 Claims, 11 Drawing Sheets

COMPOSITE CASSETTE INCLUDING A TAPE CASSETTE AND A RIBBON CASSETTE

BACKGROUND OF THE INVENTION

1. Field of the Invention

The present invention relates to a tape/ribbon composite cassette freely mountable in a label printer. The tape/ribbon composite cassette includes a tape cassette housing a tape, which serves as a print medium on which characters and the like are printed by the printer, and a ribbon cassette freely detachably mounted in the tape cassette. The present invention relates particularly to improving configuration for facilitating mounting and detaching the ribbon cassette in and out of the tape cassette and to improving positioning of the ribbon cassette in the tape cassette when the ribbon cassette is in a mounted condition in the tape cassette.

2. Description of the Related Art

Japanese Patent Application (KOKAI) No. HEI-2-106555 describes a tape-shaped label printer, which prints characters and marks, such as alphabetic characters and symbols, on a tape printing medium. The label printer is suitable for making labels to adhere to the backs of file folders. A variety of tape cassettes housing a print tape, which serves as a print medium, and an ink ribbon are available to print labels in various colors and with various widths. To change the print color or the width of the label to be produced, the tape cassette in the label printer is changed to one housing a tape with the desired width and an ink ribbon of a desired color.

Japanese Utility Model Application (KOKAI) No. HEI-3-74956 describes a composite cassette used in a label printer for preparing tape-shaped labels. The composite cassette includes an independent tape cassette and a ribbon cassette. The tape cassette houses a tape, which serves as a print medium, and is freely detachably mounted in the printer. The ribbon cassette, which houses an ink ribbon, is freely detachably mounted in the tape cassette. Various ribbon cassettes are available for housing various colored ribbons. This configuration allows allowing printing labels in various colors.

A housing opening is provided in the tape cassette for mounting the ribbon cassette in the tape cassette. The outer periphery of the ribbon cassette and the peripheral wall surface of the housing opening are formed with the same shape for positioning the ribbon cassette in the tape cassette when mounting the ribbon cassette in the tape cassette. The outer peripheral surface of the ribbon cassette is guided and fixedly positioned by the peripheral wall of the housing opening.

The tape cassette and the ribbon cassette are formed with head insertion portions through which a print head of the printer is inserted from underneath when the tape cassette is mounted to the printer. Ink ribbon from the ribbon cassette contacts the print head when transported through the head insertion portion. Tape introduced from the tape cassette contacts the outer surface of the ink ribbon at the print head. In other words, where the tape and ink ribbon are in opposition with the print head, the ink ribbon is sandwiched between the tape and the print head. A platen presses the tape against the ink ribbon and the print head. Ink from the ink ribbon can be selectively transferred to the tape by selectively energizing the print head.

As mentioned above, the ribbon cassette is guided, positioned, and fixed with regards to the tape cassette by the compatible fit of the outer peripheral surface of the ribbon cassette and the peripheral wall of the housing opening. However, in order to be able to mount the ribbon cassette into the housing opening of the tape cassette, a small gap must be provided between the peripheral wall of the housing opening and outer peripheral wall of the ribbon cassette.

If this small gap is too large, the ribbon cassette will be loosely held in the tape cassette so that precision at which the ribbon cassette is positioned in the tape cassette drops. Print quality suffers as a result because when the ribbon cassette is loosely held in the tape cassette, the ribbon is unstably transported between and in the vicinity of the print head and the platen. The position of the ink ribbon to the tape fluctuates so that a set print quality can not be achieved.

On the other hand, if the gap between the peripheral surface of the housing opening and the outer peripheral surface of the ribbon cassette is reduced to a minute gap to form a tight fit between the tape cassette and the ribbon cassette, it becomes difficult to smoothly mount the ribbon cassette to the tape cassette. Also, if the ribbon cassette expands because of heat, the ribbon cassette can become stuck in the tape cassette.

SUMMARY OF THE INVENTION

It is an objective of the present invention to provide a tape/ribbon composite cassette wherein the ribbon cassette can be smoothly and reliably mounted in and detached from the tape cassette and wherein precision at which the ribbon cassette is positioned to the tape cassette is improved.

To achieve the above-described objectives, a tape/ribbon composite cassette according to one aspect of the invention includes a tape cassette freely detachably mounted in a printer provided with a print head, the tape cassette housing a tape serving as a print medium, the tape cassette having an upper surface; a ribbon cassette freely detachably mounted in the tape cassette, the ribbon cassette housing an ink ribbon, the ribbon cassette provided with an upper surface overlapping at least a portion of the upper surface of the tape cassette; at least two guide portions provided to the tape cassette at positions separated from each other at an outer periphery of the tape cassette, the at least two guide portions guiding the ribbon cassette vertically in and out of the tape cassette; and at least two guided portions formed integrally to the upper surface of the ribbon cassette at positions corresponding to the positions of the guide portions, the at least two guided portions engaging with the guide portions to guide the ribbon cassette vertically in an out of the tape cassette.

With this configuration, the ribbon cassette can be easily installed in the tape cassette because the surface area with which the ribbon cassette contacts the tape cassette is limited. The position of the ribbon cassette with regards to the tape cassette can be precisely maintained.

According to another aspect of the invention, the at least two guide portions include three guide portions and the at least two guided portions include three guided portions. With this configuration, the ribbon cassette can still be easily mounted in the tape cassette because the ribbon cassette contacts the tape cassette at only three locations. Positioning is extremely precise because of the stable triad relationship of the guide portions and guided portions.

According to still another aspect of the invention, at least one grip provided to the upper surface of the ribbon cassette. With this configuration, a user can easily mount or detach the ribbon cassette to and from the tape cassette by grasping the grip.

According to a further aspect of the invention, the tape/ribbon composite cassette further includes a tape guide provided to an outer periphery of the tape cassette at a position upstream from the tape exposure portion in a direction in which the tape is fed, a side of the tape guide facing the ribbon cassette being open; and a ribbon guide provided to an outer periphery of the ribbon cassette at a position upstream from the gap of the head insertion portion in a direction in which the ribbon is fed, a side of the ribbon guide facing the tape cassette being open.

With this configuration, the ink ribbon and the tape can be transported near each other and in parallel with each other when transported past the print head.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
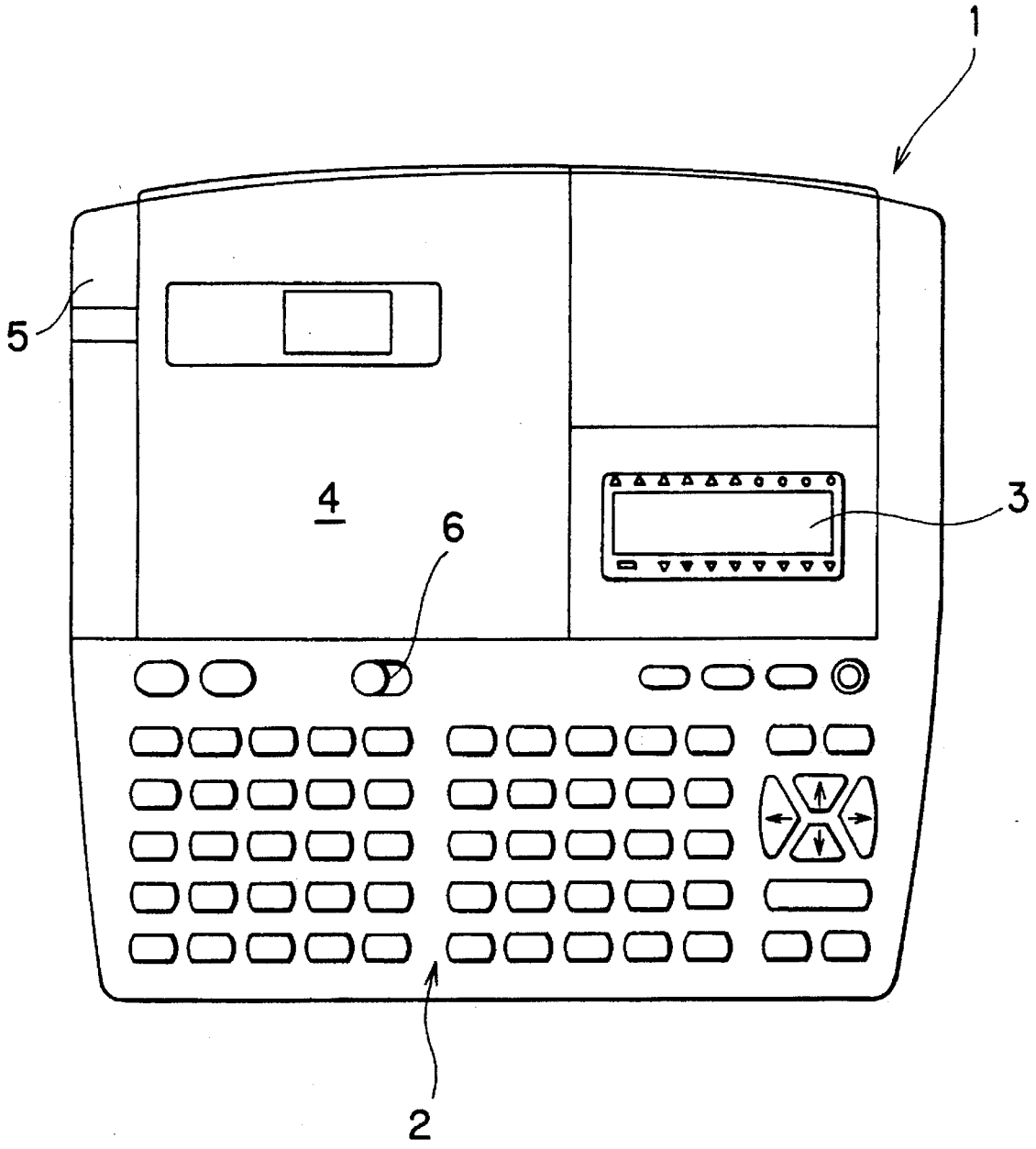
FIG. 1 is a plan view showing a printer in which a tape/ribbon composite cassette according to a first embodiment of the present invention is used.

A tape/ribbon composite cassette according to preferred embodiments of the present invention will be described while referring to the accompanying drawings wherein like parts and components are designated by the same reference numerals to avoid duplicating description. The expressions frontward, backward, rightward, and leftward are used as indicated in the drawings unless otherwise mentioned. Other directional expressions such as up and down are used hereinafter to define various parts when the label printer is disposed in an orientation in which it is intended to be used.

The preferred embodiments describe the present invention applied to a label printer and to a tape/ribbon composite cassette used in the printer. In the embodiments the label printer is for producing tape-shaped labels by printing colored text, symbols, and characters on a tape, which serves as a print medium. The tape/ribbon composite cassette includes a tape cassette freely detachably mounted in the printer and a ribbon cassette freely detachably mounted in the tape cassette.

Figure 2:
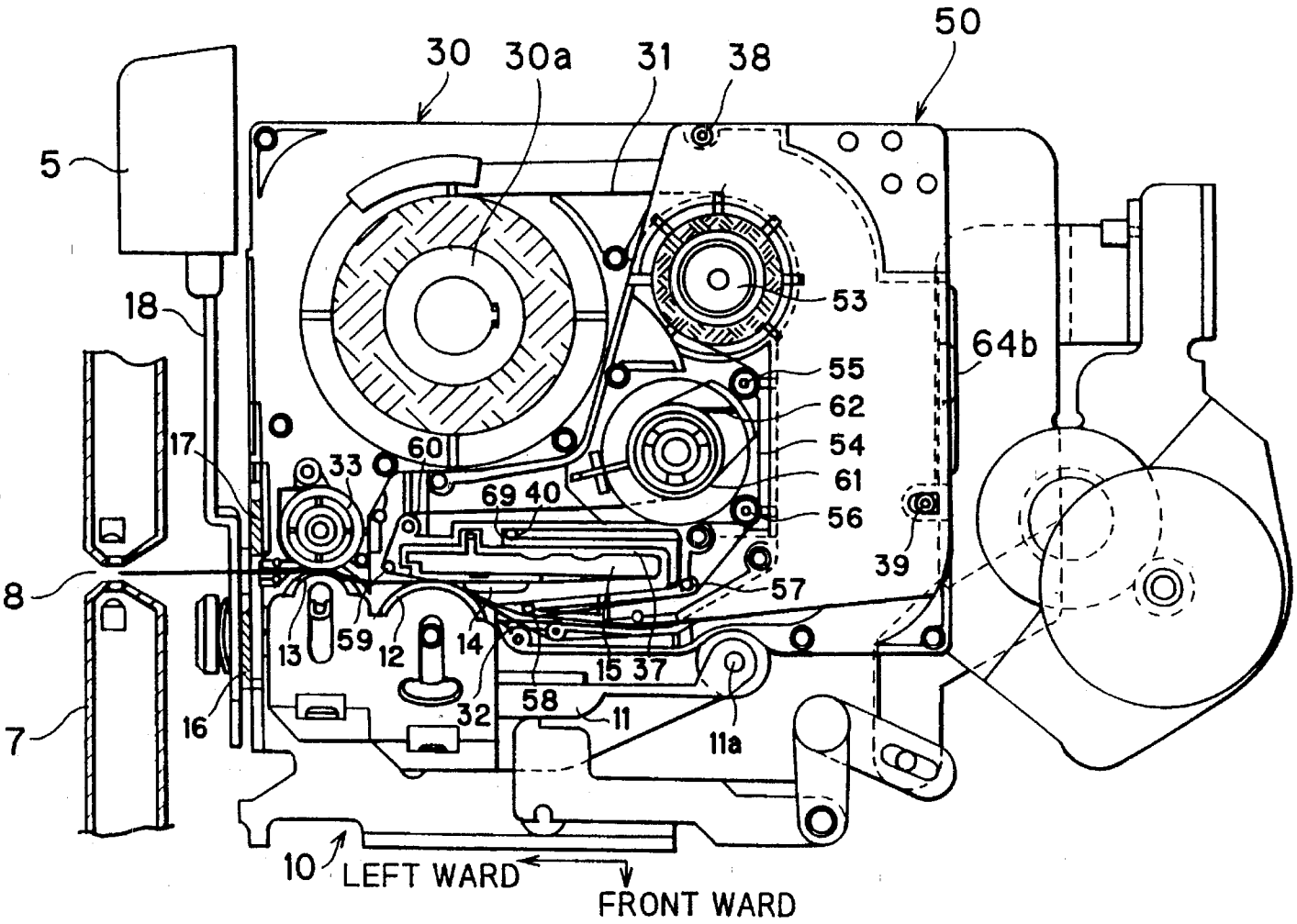
FIG. 2 is a horizontal cross-sectional view showing the tape/ribbon composite cassette mounted in a print mechanism of the printer and partially showing internal components of the tape/ribbon composite cassette.

First, a simple explanation of the label printer will be provided. As shown in FIG. 1, a printer 1 is provided at its upper surface with a keyboard 2, a display 3, a cassette cover 4, a cutter lever 5, and the like. The cassette cover 4 is designed to open up when a cover open lever 6 is slid to the right as viewed in FIG. 1. A print mechanism 10 shown in FIG. 2 is disposed beneath the cassette cover 4. A tape/ribbon composite cassette 100 can be mounted into the print mechanism 10 while the cassette cover 4 is opened up.

Figure 3:
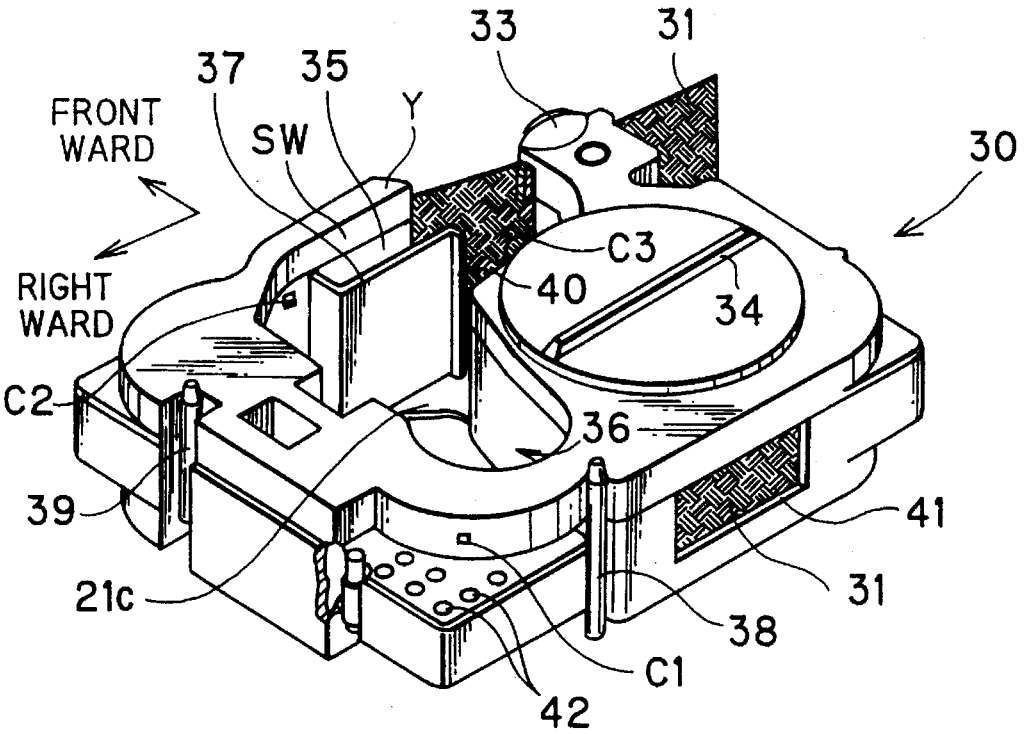
FIG. 3 is a perspective view showing a tape cassette of the tape/ribbon composite cassette of FIG. 2.
Figure 4:
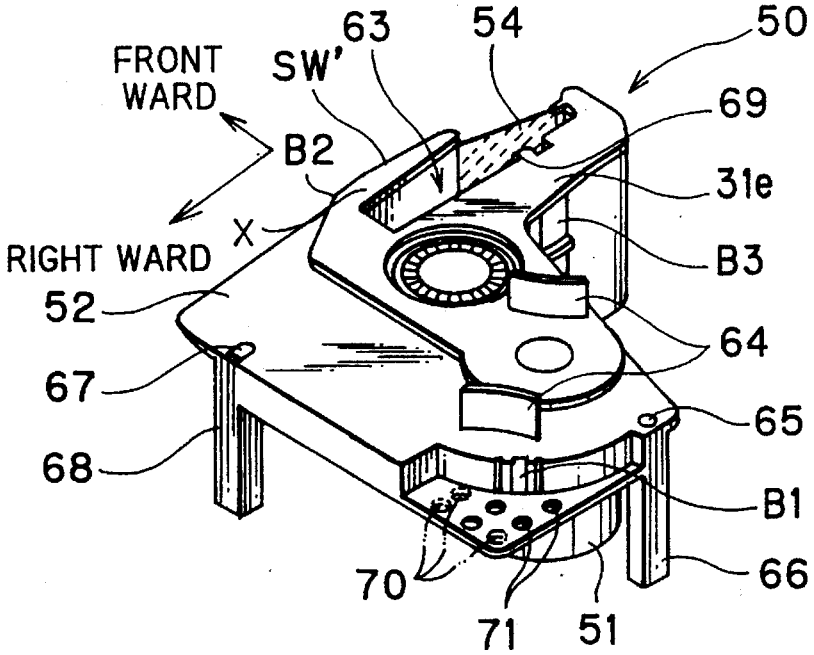
FIG. 4 is a perspective view showing a ribbon cassette of the tape/ribbon composite cassette of FIG. 2.
Figure 5:
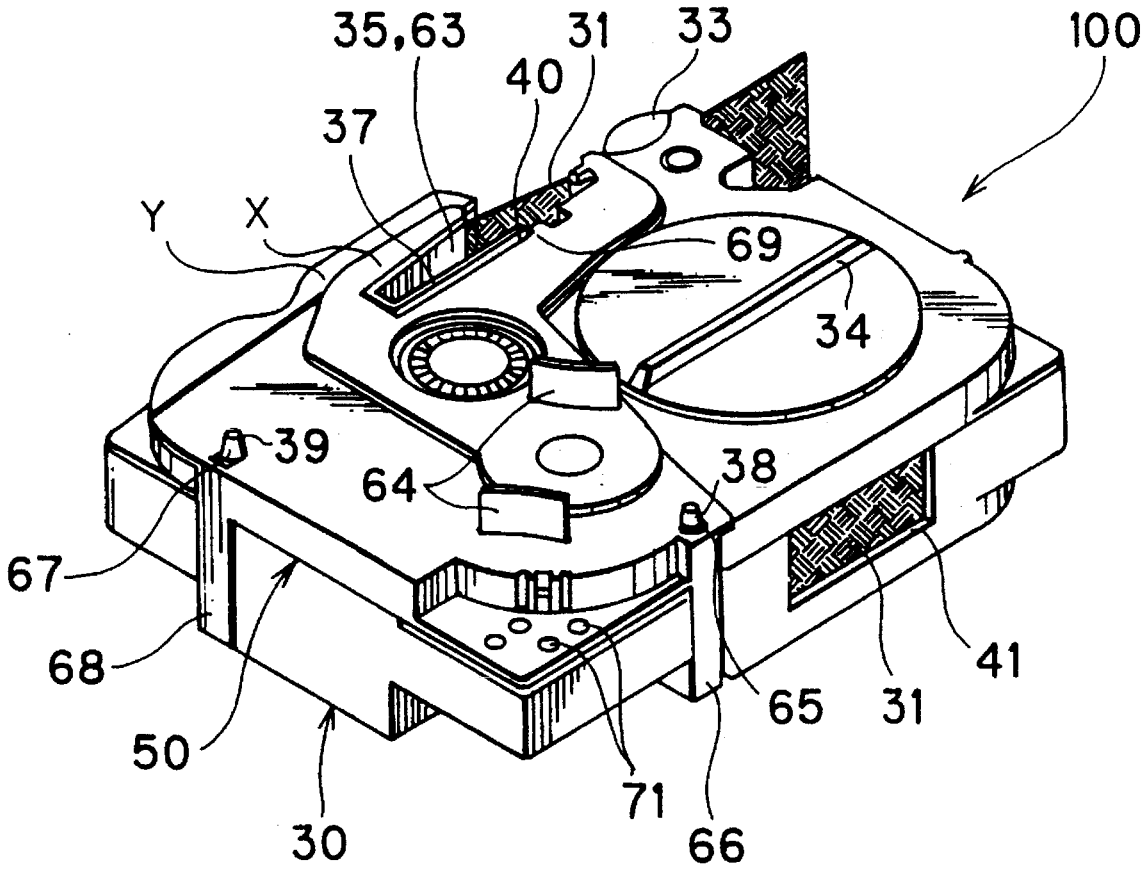
FIG. 5 is a perspective view showing the tape/ribbon composite cassette with the ribbon cassette mounted in the tape cassette of FIG. 2.

The composite cassette 100 includes a tape cassette 30 and a ribbon cassette 50, both constructed in independent form. It should be noted that FIG. 3 shows the tape cassette 30, that FIG. 4 shows the ribbon cassette 50, and that FIG. 5 shows the tape-ribbon composite cassette 100, wherein the ribbon cassette 50 is mounted in the tape cassette 30. The tape cassette 30 can be freely mounted into or detached from the print mechanism 10 from above the print mechanism 10. The main body 51 of the ribbon cassette 50 is formed to fit in the housing portion 36 of the tape cassette 30 so that the ribbon cassette 50 can be freely mounted into or detached from the tape cassette 30 while the tape cassette 30 is mounted in the print mechanism 10. The ribbon cassette 50 is mounted so that its upper wall 52 covers an upper surface of the tape cassette 30 and so its lower surface abuts a floor section 21*c* of the tape cassette 30. Three pawls B1, B2, and B3 are provided to the ribbon cassette 50. Three pawls C1, C2, and C3 are provided to the tape cassette 30 at positions thereof corresponding to the positions of the three pawls B1, B2, and B3 of the ribbon cassette 50.

Next, a brief explanation of the print mechanism 10 will be provided while referring to FIG. 2. A platen 12 and a sub roller 13 are provided to a roller holder 11 so as to swing integrally with the roller holder 11 on an axial shaft 11*a*. The roller holder 11 is configured so as to swing open and closed in association with opening and closing movements of the cassette cover 4. A thermal head 14 and a head holder 15 for supporting the thermal head 14 are provided at a position near the rear of the platen 12.

As shown in FIG. 2, a tape 31, which serves as a print medium, is wound around a tape spool 30*a* mounted in the tape cassette 30. The tape 31 is guided from the rear vicinity of the tape spool 30*a*, through an arched tape guide pathway having a substantially reversed C-shape, as viewed in FIG. 2, and toward a tape discharge port 32 in front of the thermal head 14. The tape 31 is finally guided out of the tape cassette 30 by concerted operation of a tape feed roller 33, provided to the tape cassette 30, and the tape feed sub roller 13.

A tape grip 34 shown in FIG. 3 is engaged with the tape spool 30*a* so as to rotate integrally with the tape spool 30*a*.

With this configuration, the tape 31 can be rewound by manually rotating the tape grip 34. A window opening 41 for feeding the tape 31 in the tape guide pathway is formed in the tape cassette 30. Another window (not shown in the drawings) is formed in the opposite side in the front wall in the same manner as the window 41. Although multi-colored printing is possible by replacing the ribbon cassette 50 of the tape/ribbon composite cassette 100, the tape 31 must be rewound to accomplish this. The window opening 41 is provided for tape feed operations required to rewind the tape 31.

As also shown in FIG. 3, a head insertion portion 35 into which the thermal head 14 and head holder 15 are inserted from underneath is formed in the horizontal center of the area near the front of the tape cassette 30. Also, a housing portion 36, having a floor 21*c*, for housing the main body 51 of the ribbon cassette 50 is formed in the tape cassette 30 to the left center as viewed in FIG. 3. An L-shaped partition wall 37 for partially partitioning the head insertion portion 35 from the housing portion 36 is formed with an upright posture to the floor 21*c*.

As shown in FIG. 2, an ink ribbon 54 is wound around a ribbon spool 53 mounted in the ribbon cassette 50. The ink ribbon 54 is guided by ribbon guides 55 through 58 toward the front surface of the thermal head 14. Then the ink ribbon 50 passes by a guide rod 59 and a ribbon guide 60 and is wound around a take-up spool 61. A clutch spring 62 for preventing the ink ribbon from loosening is attached below the tape-up spool 61.

As shown in FIG. 4, a lid 31*e* is provided on the ribbon case 31 to support, from above, parts such as the ribbon spool 53, the take-up spool 61, and the like. Also, a head insertion portion 63, into which the partition wall 37 and the thermal head 14 are inserted, is formed to the left portion near the front edge of the ribbon cassette 50. A pair of grips 64 are formed to the ribbon cassette 50, one to the lid 31*e* of the ribbon cassette 50 and one to the upper surface 52 of the ink ribbon 50. The pair of grips 64 allow easy attachment and detachment of the ribbon cassette 50 by grasping these grips 64 between the fingers.

When the cassette cover 4 is closed up from an open condition, the roller holder 11 swings in association with movement of the cassette cover 4 toward the thermal head 14 so that the platen 12 comes into pressing contact with the thermal head 14 and so that the sub roller 14 comes into pressing contact with the tape feed roller 33. As shown in FIG. 2, the ink ribbon 54 guided in front of the thermal head 14 is brought into contact with the front surface of the thermal head 14 and the tape 31 guided in front of the thermal head 14 is brought into contact with the ink-covered surface of the ink ribbon 54. The thermal head 14 prints character trains and the like in dot patterns on the tape 31 via the ink ribbon while the platen 12 presses the ink ribbon and the tape 31 against the thermal head 14. The tip of the printed tape 31 is transported through a cutter, which includes a movable blade 16 and a receiver blade 17, and is discharged out of a slit 8 formed in the main case 27. The movable blade 16 is connected to a cutter lever 5. Printed tapes 31 are cut to a desired size by the movable blade 16 and the receiver blade 17 by operating the cutter lever 5.

Next, an explanation will be provided for a guide positioning mechanism according to the first embodiment of the present invention will be provided while referring to FIGS. 3 to 5. The guide positioning mechanism is for guiding and positioning the ribbon cassette 50 with regards to the tape cassette 30 during and after mounting of the ribbon cassette 50 from overhead the tape cassette 30.

The tape cassette 30 is provided with upright pin-shaped guide portions 38, 39, and an upright rib-shaped guide portion 40. The pin-shaped guide portion 38 is provided to the rear edge of the tape cassette 30. The pin-shaped guide portion 39 is provided to the left edge of the tape cassette 30. The rib-shaped guide portion 40 is provided to the rear edge of the partition wall 37. The upper tip of the pin-shaped guide portions 38, 39 are formed if a tapered shape.

The ribbon cassette 50 is provided with a pillar-shaped guided portion 66, a pillar-shaped guided portion 68, and an L-shaped guided portion 69. The pillar-shaped guided portion 66 has formed therein an engaging hole 65 for engaging with the pin-shaped guide portion 38 with a minute gap between the outer periphery of the pin-shaped guide portion 38 and the inner periphery of the engaging hole 65. The pillar-shaped guided portion 68 has formed therein an engaging hole 67 for engaging the pin-shaped guide portion 39 with a minute gap therebetween in the frontward and rearward directions, but with a relatively large gap therebetween in the leftward and rightward directions. Therefore, the pin-shaped guide portion 39 is engaged in the engaging hole 67 with little play in the frontward and rearward directions, but with free play in the leftward and rightward directions. With this configuration, the pin-shaped guide portion 39 engages tightly with the engaging hole 67 in the direction in which the thermal head 14 is separated from the tape 31, which is direction most important for maintaining good printing quality, while remaining easy to engage in the direction perpendicular to this. It should be noted that the pin-shaped guide portions 38, 39 are formed to a length to protrude from the upper surface of the tape cassette 30 when engaged in the engaging holes 65, 67. The L-shaped guided portion 69 is engagable with the rib-shaped guide portion 40 and provides precise positioning in the frontward, rearward, leftward, and rightward directions. The L-shaped guided portion 69 is provided to the rear edge of the head insertion portion 63 at a position corresponding to the rear of the thermal head 14.

When mounting the ribbon cassette 50 into the tape cassette 30, the user grasps the grips 64 of the ribbon cassette 50 and aligns the plurality of guided portions 66, 68, 69 of the ribbon cassette 50 with the plurality of guide portions 38, 39, 40 of the ribbon cassette 30. The user then applies to the ribbon cassette a downward force required for attaching and detaching the ribbon cassette, thereby engaging guide portions 38, 39, 40 with corresponding guided portions 66, 68, 69.

If the pin-shaped guide portions 38, 39 are constructed to tightly engage in the engagement holes 65, 67 without gaps therebetween, the ribbon cassette 50 could be accurately positioned with regards to the tape cassette 30 without providing the rib-shaped guide portion 40 and the L-shaped guided portion 69. However, in this case the tight fit of the pin-shaped guide portions 38, 39 would produce a large resistance to sliding, making the ribbon cassette 50 difficult to smoothly attach to and detach from the tape cassette 30. Therefore, it is desirable to provide positioning members at three separate positions to increase precision at which the ribbon cassette 50 is positioned in the tape cassette 30.

In the present embodiment, guide portions are formed at three mutually separated positions of the tape cassette and three corresponding guided portions of the ribbon cassette are engaged therewith to guide and position the ribbon cassette with regards to the tape cassette. The guide portions and guided portions maintain the positioning of the ribbon cassette and the tape cassette after the ribbon cassette is mounted in the tape cassette.

Positioning is highly precise because the ribbon cassette is positioned by the guide portion/guided portion pairs provided at three separate positions. Particularly, by forming the three guide portion/guided portion pairs so as to be elongated in the direction in which the ribbon cassette is mounted and detached, the surface area where pairs of the three guide portion/guided portion pairs come in contact is reduced. Therefore, resistance against sliding when the ribbon cassette is mounted is reduced so that the ribbon cassette can be easily mounted or detached. Also, resistance against sliding will remains insignificant even if only a small gap, for allowing sliding movement, is provided between corresponding guide portions and the guided portions. Therefore the sliding gap can be made sufficiently small to allow highly precise positioning.

With the above-described configuration, the rib-shaped guide portion 40 and the L-shaped guided portion 69 accurately position the ribbon cassette 50 to the tape cassette 30 in the vicinity of the thermal head in the frontward, rearward, leftward, and rightward directions. As a result, precision at which the ribbon cassette is positioned in the tape cassette is increased in the vicinity of the head insertion portion formed in the tape cassette and the ribbon cassette. The ribbon cassette can be tightly fitted in the tape cassette so that stable printing quality can be achieved. If the ribbon cassette 50 is positioned in the tape cassette 30 with poor accuracy in the frontward and rearward directions near the thermal head 14, then when the ribbon cassette 50 is mounted into the tape cassette 30 from overhead, problems may occur such as unstable print quality or ribbon jams caused by the upper edge of the tape 31 snagging on the lower edge of the ink ribbon 54.

The ribbon cassette 50 is positioned two-dimensionally in the horizontal direction by engaging the engagement holes 65, 67 to the pin-shaped guide portions 38, 39 respectively when mounting the ribbon cassette 50. The ribbon cassette 50 is positioned vertically with regard to the tape cassette 30 by abutting the upper surface 52 of the ribbon cassette 50 against the upper surface of the tape cassette 30 and the lower surface of the ribbon cassette 50 against the floor 21*c* of the tape cassette 30. Engagement of the ribbon cassette pawls B1, B2, and B3 with the tape cassette pawls C1, C2, and C3 positions in the horizontal and vertical directions, and detachably fixes, the ribbon cassette 50 with regards to the tape cassette 30.

Therefore, the ribbon cassette 50 is mounted without the outer peripheral wall of the ribbon cassette 50 contacting the peripheral surface of the housing portion 36 of the tape cassette 30. For this reason, resistance to sliding when the ribbon cassette 50 is mounted can be reduced so that the ribbon cassette 50 can be smoothly slidingly attached and detached with only a slight force. Accordingly, the ribbon cassette 50 can be mounted more smoothly than in conventional tape/ribbon composite cassettes wherein the ribbon cassette and the tape cassette are positioned by contact between the peripheral wall of the ribbon cassette and the peripheral surface of the tape cassette. Also, the ribbon cassette 50 can be replaced while the tape cassette 30 is mounted in the print mechanism 10.

A plurality of freely retractable detection elements 42 are provided in a corner of the tape cassette 30. A plurality of detection switches (not shown in the drawings) corresponding to the plurality of detection elements 42 are provided in the print mechanism 10. The plurality of detection switches raise corresponding detection elements 42 upward by a predetermined stroke.

One or a plurality of operation portions 70 and one or a plurality of escape holes 71 are formed in one corner of the ribbon cassette 50. Although the operation portions 70 selectively press the plurality of detection elements 42 down, the escape holes 71 do not. The detection switches are pressed down and turned on by detection elements 42 that are pressed down by the operation portions 70. The detection switches, the detection elements 42, the operation portions 70, and the escape holes 71 are provided for detecting the type of tape cassette 30, that is, the type of tape 31, and the type of ribbon cassette 50, that is, the type of ink ribbon 50.

As described above, the tape/ribbon composite cassette 100 used in the label printer 1 is provided with a positioning mechanism including guide portions 38, 39, 40, and pilaf-shaped guided portions 66, 68 having engagement holes 65, 67. Therefore, during and after mounting of the ribbon cassette 50 to the tape cassette 30, the ribbon cassette 50 can be positioned with high precision with regards to the tape cassette 30.

Particularly, the rib-shaped guide portion 40 and the L-shaped guided portion 69 securely fix the position of the ribbon cassette 50 with regards to the tape cassette 30 in the direction in which the portion of the ink ribbon 54 confronting the head insertion portions 35, 63 is separated from the tape 31 near the outer periphery of the ink ribbon 54, that is, in a direction perpendicular to the direction in which the tape 31 and ink ribbon 54 are transported past the print head 14. Therefore, ribbon jams will not occur because the upper edge of the tame 31 Will not interfere with the lower edge of the ink ribbon 54 when the ribbon cassette 50 is mounted into the tape cassette 30. Also print quality will not fluctuate because the positional relationship between the tape 31 and the ink ribbon 54 is maintained in a fixed condition near the thermal head 14.

Further, the outer peripheral wall of the main body 51 of the ribbon cassette 50 is configured so as not to contact the peripheral surface of the housing portion 36 of the tape cassette 30 so that little resistance to sliding is generated between the pin-shaped guide portions 38, 39 and the engagement holes 65, 67. Therefore, the ribbon cassette 50 can be smoothly mounted in the tape cassette 30 using little force.

Figure 6:
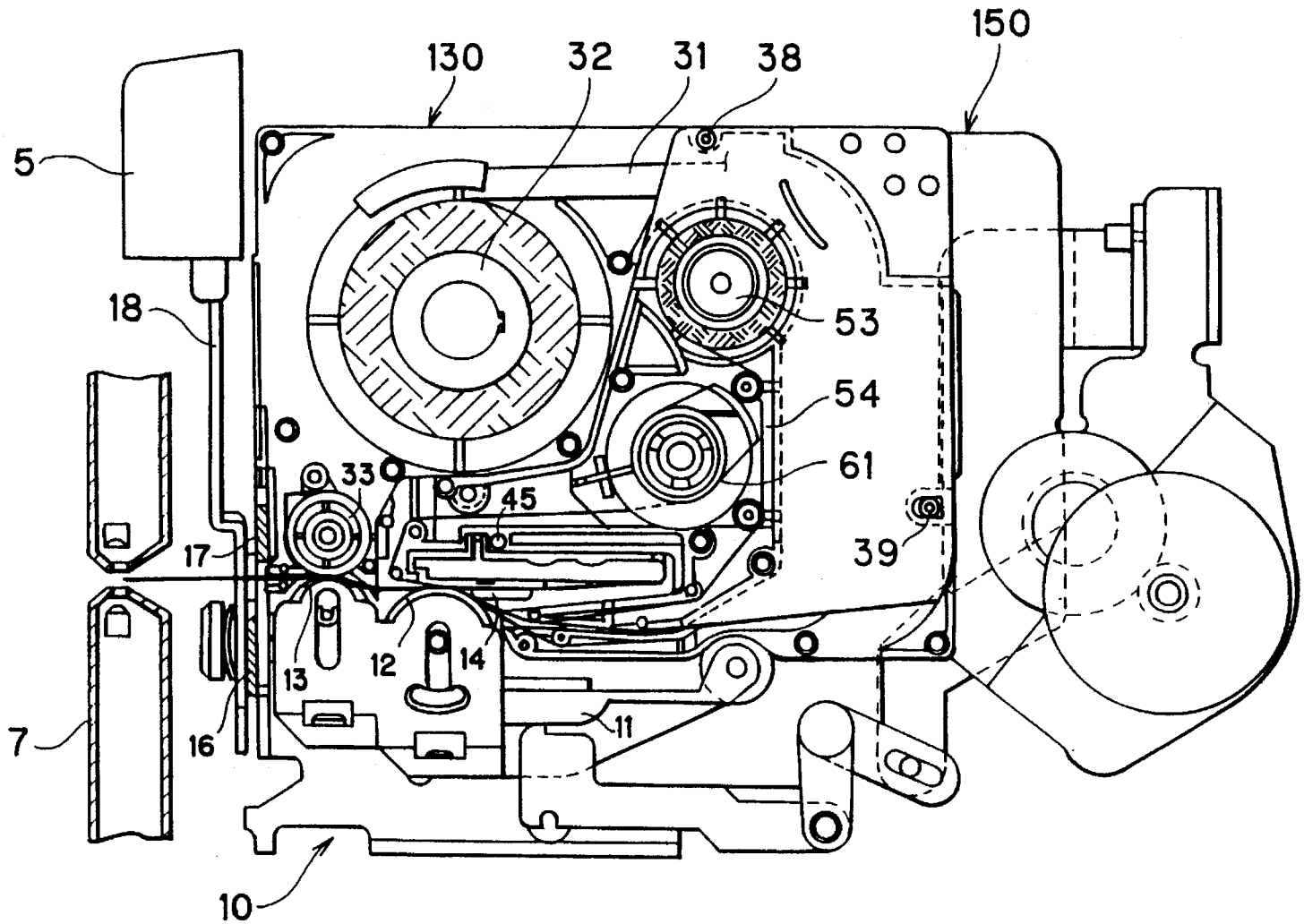
FIG. 6 is a horizontal cross-sectional view showing a tape/ribbon composite cassette according to a second embodiment mounted in the print mechanism.
Figure 7:
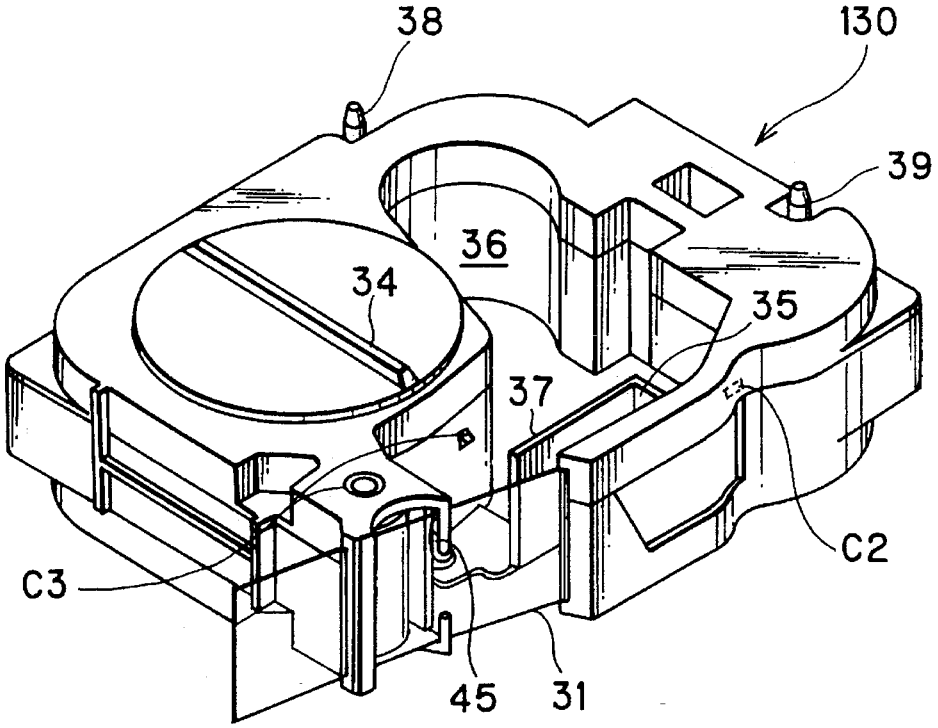
FIG. 7 is a perspective view showing a tape cassette of the tape/ribbon composite cassette of FIG. 6.
Figure 8:
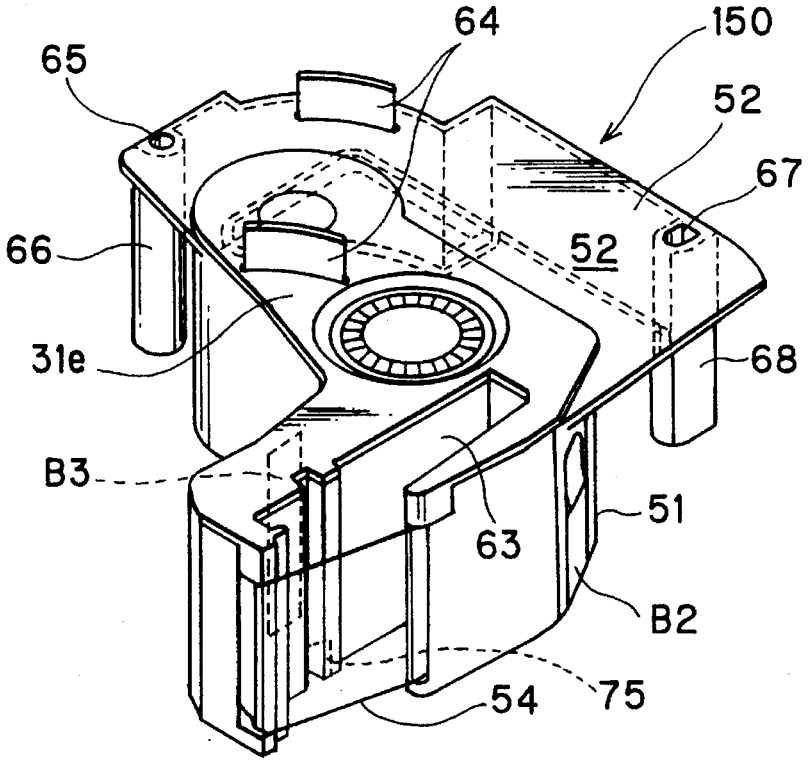
FIG. 8 is a perspective view showing a ribbon cassette of the tape/ribbon composite cassette if FIG. 6.

Next, an explanation of a guide positioning mechanism according to a second embodiment will be provided while referring to FIGS. 6 through 8.

The guide positioning mechanism of the second embodiment is a partial modification of the guide positioning mechanism of the first embodiment. That is, the pin-shaped guide portions 38, 39, the engagement holes 65, 67, and the pillar-shaped guided portions 66, 68 of this guide positioning mechanism are the same as described above. However, a pin-shaped guide portion 45 and hole-shaped guided portion 75 are provided in place of the rib-shaped guide portion 40 and the L-shaped guided portion 69 respectively.

The pin-shaped guide portion 45 is provided to the floor of the housing portion 36 near the rear of the head insertion portion 35 of the tape cassette 130. The positioning pin-shaped guide portion 45 protrudes slightly upward and has a tapered upper tip. The hole-shaped guided portion 75 is formed in the lower portion of the main body 51 of the ribbon cassette 150 at the area corresponding to the pin-shaped guide portion 45. The hole-shaped guided portion 75 is formed to tightly engage the pin-shaped guide portion 45, that is, so that almost no gap remains between the outer periphery of the pin-shamed guide portion 45 and the hole-shaped guided portion 75.

Accordingly, the pin-shaped guide portion 45 engages with the hole-shaped guided portion 75 when the ribbon cassette 150 is almost completely mounted in the tape cassette 130 and maintains this engagement condition after mounting. For this reason, the ribbon cassette 150 can be precisely positioned to the tape cassette 130 in the vicinity of the thermal head 14. Therefore, the same effects can be achieved as achieved for the guide positioning mechanism of the tape/ribbon composite cassette 100 described in the first embodiment.

Figure 9:
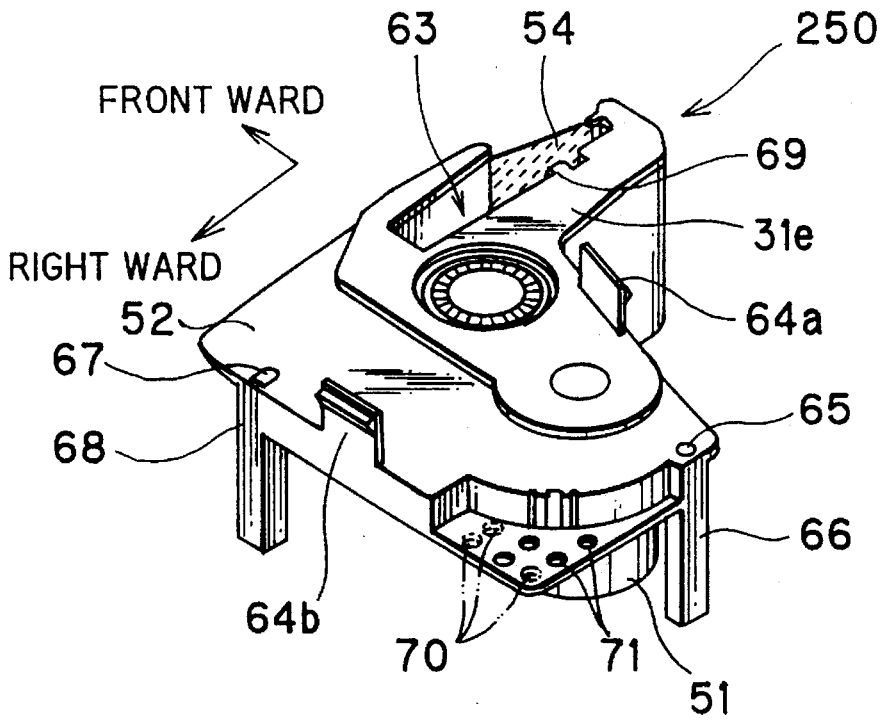
FIG. 9 is a perspective view showing a ribbon cassette according to a third embodiment of the present invention.
Figure 10:
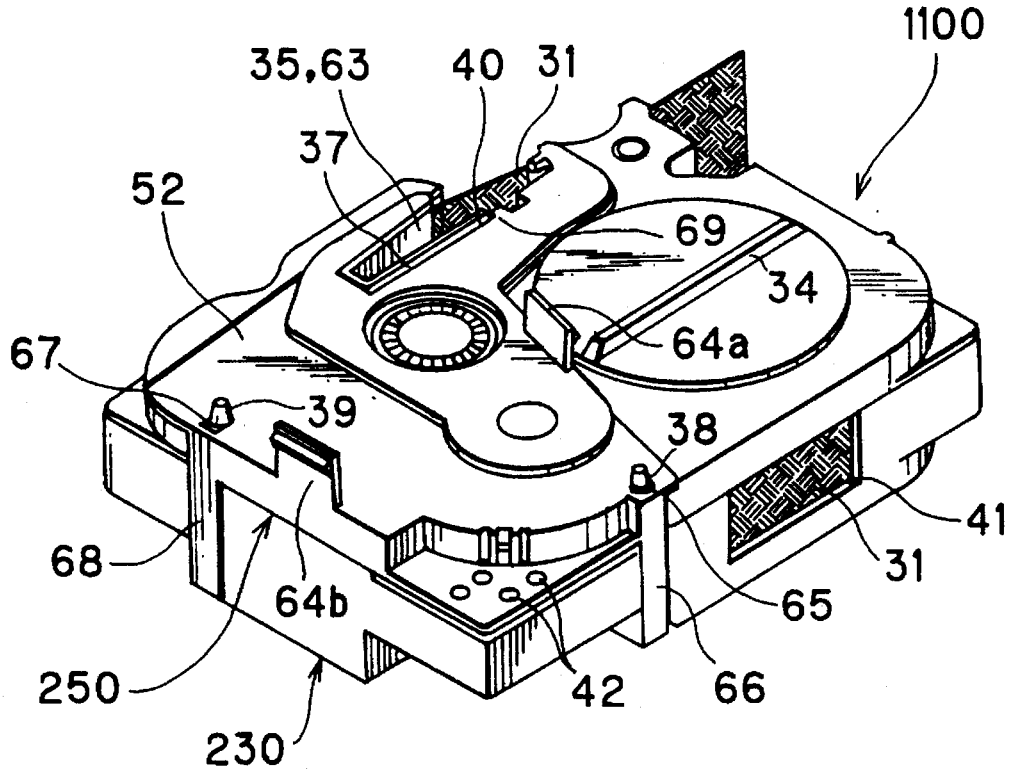
FIG. 10 is a perspective view showing the ribbon cassette of FIG. 9 mounted in a tape cassette.
Figure 11:
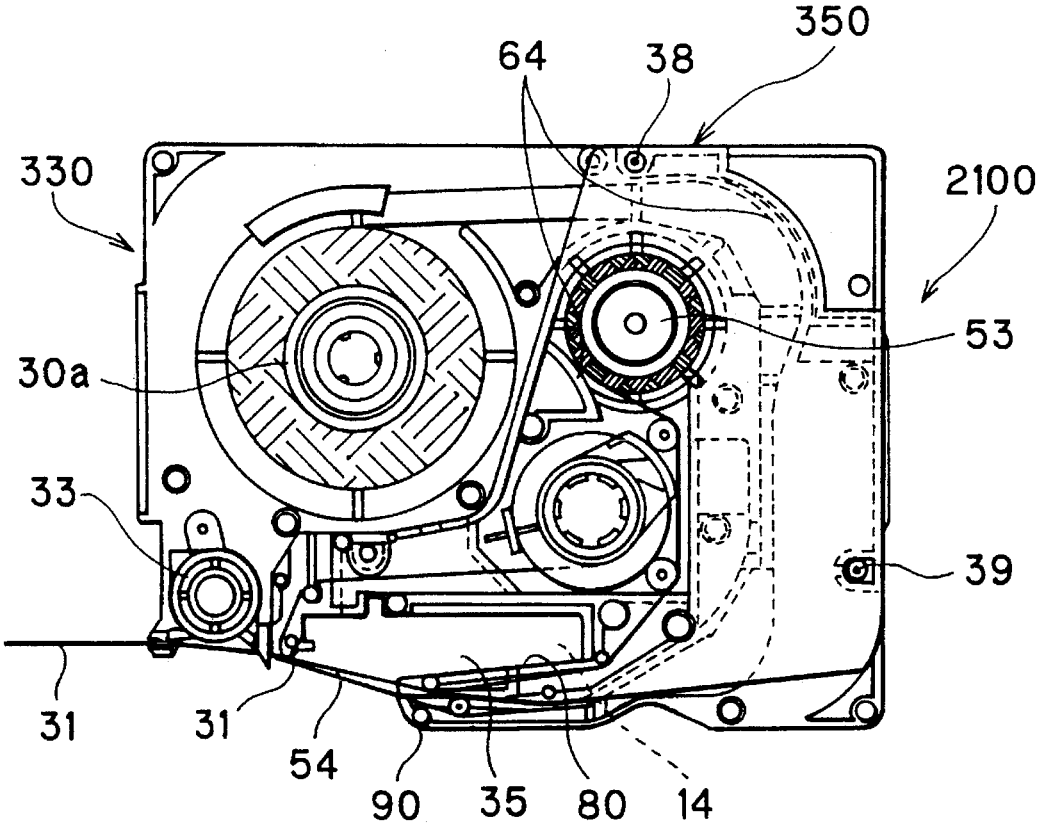
FIG. 11 is a horizontal cross-sectional view showing a tape/ribbon composite cassette according to a fourth embodiment mounted in the print mechanism.

Next, a third embodiment of the present invention will be provided with reference to FIGS. 9 and 10. A pair of rectangular-shaped grips 64*a*, 64*b* are formed integrally to a side wall of a ribbon cassette 250 and extend vertically to protrude above the upper surface 52 of the ribbon cassette 250. The grip 64*a* is disposed at a position substantially central, as viewed from above, between the engagement hole 65 and the L-shaped guided portion 69. The grip 64*b* is disposed at a position between, as viewed from above, the engagement hole 67 and the engagement hole 65, but nearer the engagement hole 67.

The grip 64*a* and the grip 64*b* are disposed centered substantially equidistant, as viewed from above, from the center of gravity G of the ribbon cassette 250, although the center of gravity G will fluctuate somewhat depending on wound condition of the ribbon 54. The center of gravity G of the ribbon cassette 50 is defined as the center of gravity of a triangle formed by connecting the engagement hole 65, the engagement hole 67, and the L-shaped guided portion 69.

With this configuration, the grip 64*a* is provided centrally, as viewed from above, between the engagement hole 65 and the L-shaped guided portion 69, the grip 64*b* is provided almost centrally between the engagement hole 65 and the engagement hole 67, and these grips 64*a*, 64*b* are disposed centered on the center of gravity G. Because the center of gravity of the ribbon cassette 50 is also central between the grip 64*a* and the grip 64*b*, rotational momentum will not be imparted on the ribbon cassette 50 when the ribbon cassette 50 is mounted into the tame cassette 30. Therefore, a user can easily support the ribbon cassette 50 in a horizontal untilted posture by grasping the grips 64*a*, 64*b* so that the ribbon cassette 50 can be smoothly mounted into the tape cassette 30. Also, when the ribbon cassette 50 is mounted into the tape cassette 30, the force required to attach and detach the ribbon cassette 50 is imparted uniformly to the pillar-shaped guided portions 66, 68, and the L-shaped guided portion 69 so that the ribbon cassette 50 can be smoothly mounted into the tape cassette 30. Detachment of the ribbon cassette 50 from the tape cassette 30 can be performed with similar ease using the grips 64*a*, 64*b*.

In the above-described embodiments, the tape 31 and the ink ribbon 54 are exposed when transported past the print head 14. The portion of the ribbon cassette defining the gap through which the ink ribbon is exposed will be referred to as the ribbon exposure portion hereinafter. The portion of the tape cassette defining the gap through which the tape 31 is exposed will be referred to as the tape exposure portion hereinafter.

The tape/ribbon composite cassette of the above-described embodiments are provided with guides for guiding the ink ribbon 54 and tape 31 directly before the tape 31 and the ink ribbon 54 are drawn through the head insertion portions 35, 63. For example, as shown in FIGS. 3 through 5, guides X, Y are provided to the ribbon cassette 250 and the tape cassette 230 respectively. The ribbon guide X is formed from a pair of guide walls between which the ink ribbon 54 is guided. Similarly, the tape guide Y is formed from a pair of guide walls between which the tape 31 is guided. Separation walls SW, SW' are provided to the tape guide Y and the ribbon guide X respectively for preventing contact between the tape 31 from the 54.

It is desirable that tape 31 and the ink ribbon 54 be transported close to and substantially parallel with each other when in opposition with the print head. Therefore, it would be desirable to form the separation walls SW, SW', shown in opposition in FIG. 5, as thin as possible. However, the separation walls SW, SW' of the tape guide Y and the ribbon guide X can only be formed so thin before structural support becomes insufficient to properly prevent the guides from deforming and bending. The width of the opposing walls increases with the width of the tape 31 housed in the tape cassette. The wider the opposing walls are formed the thicker the walls need to be formed to provide sufficient structural support.

Figure 12:
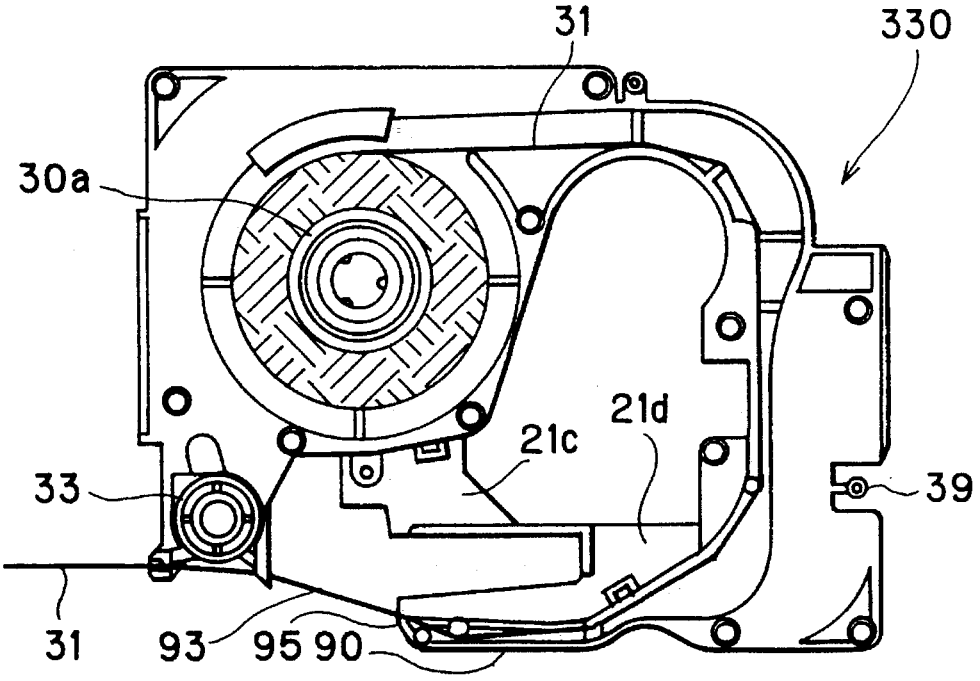
FIG. 12 is a horizontal cross-sectional view showing a tape cassette of the tape/ribbon composite cassette of FIG. 11.

With this structural need in mind, a tape/ribbon composite cassette according to a fourth embodiment of the present invention will be explained while referring to FIGS. 11 through 15. As shown in FIGS. 12 and 14, a tape guide 80 for guiding the tape 31 to the thermal head 14 is formed in the tape cassette 330. The side of the tape guide 80 facing the head insertion portion 35 is open. Separation members 95 for preventing contact between the tape 31 and the ink ribbon 32 by separating the two by a distance are formed along inward facing edges of the tape guide 80.

As mentioned in the third embodiment, the tape 31 is exposed near the thermal head 14 at a gap 93 defined by a tape exposure portion. In the fourth embodiment, the gap 93 is defined by the tip of the tape guide 80 and the portion of the tape cassette 330 housing the tape feed roller 33. Said differently, the gap 93 is downstream, with regards to the transport direction of the tape 31, from the tape guide 80 and upstream from the tape feed roller 33.

Figure 13:
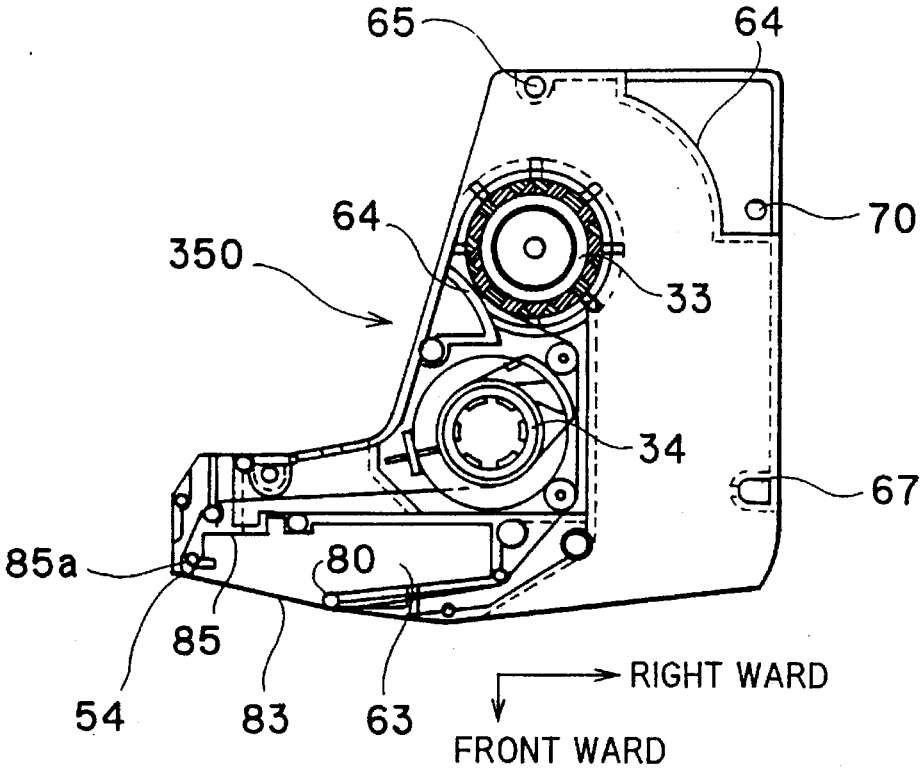
FIG. 13 is a horizontal cross-sectional view showing a ribbon cassette of the tape/ribbon composite cassette of FIG. 11.
Figure 15:
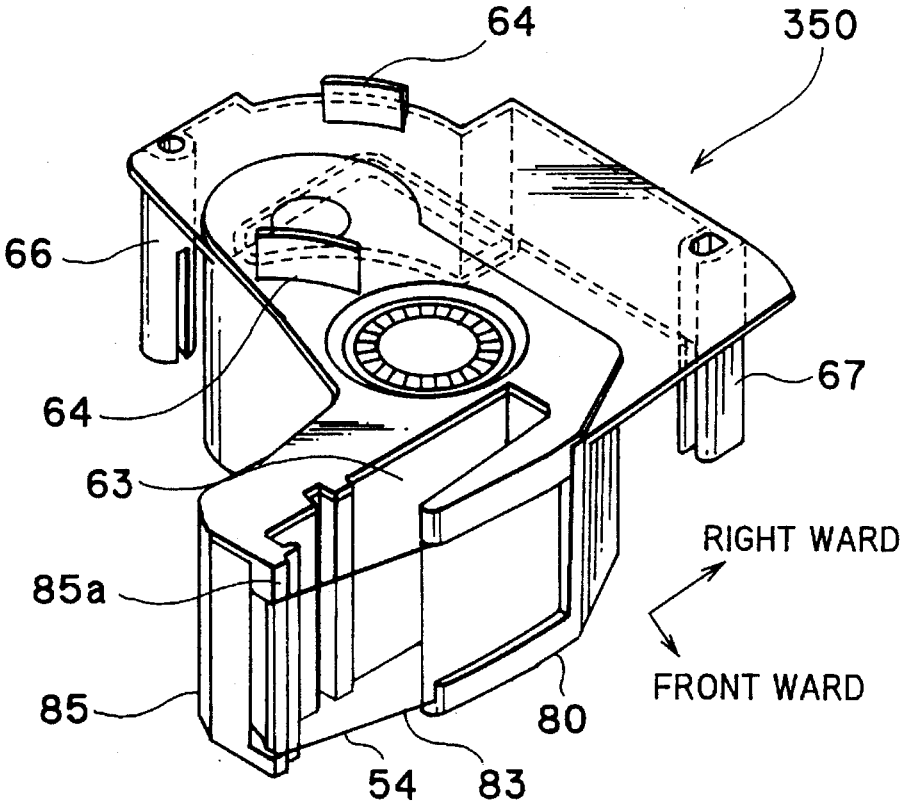
FIG. 15 is a perspective view showing the ribbon cassette of FIG. 13.
Figure 14:
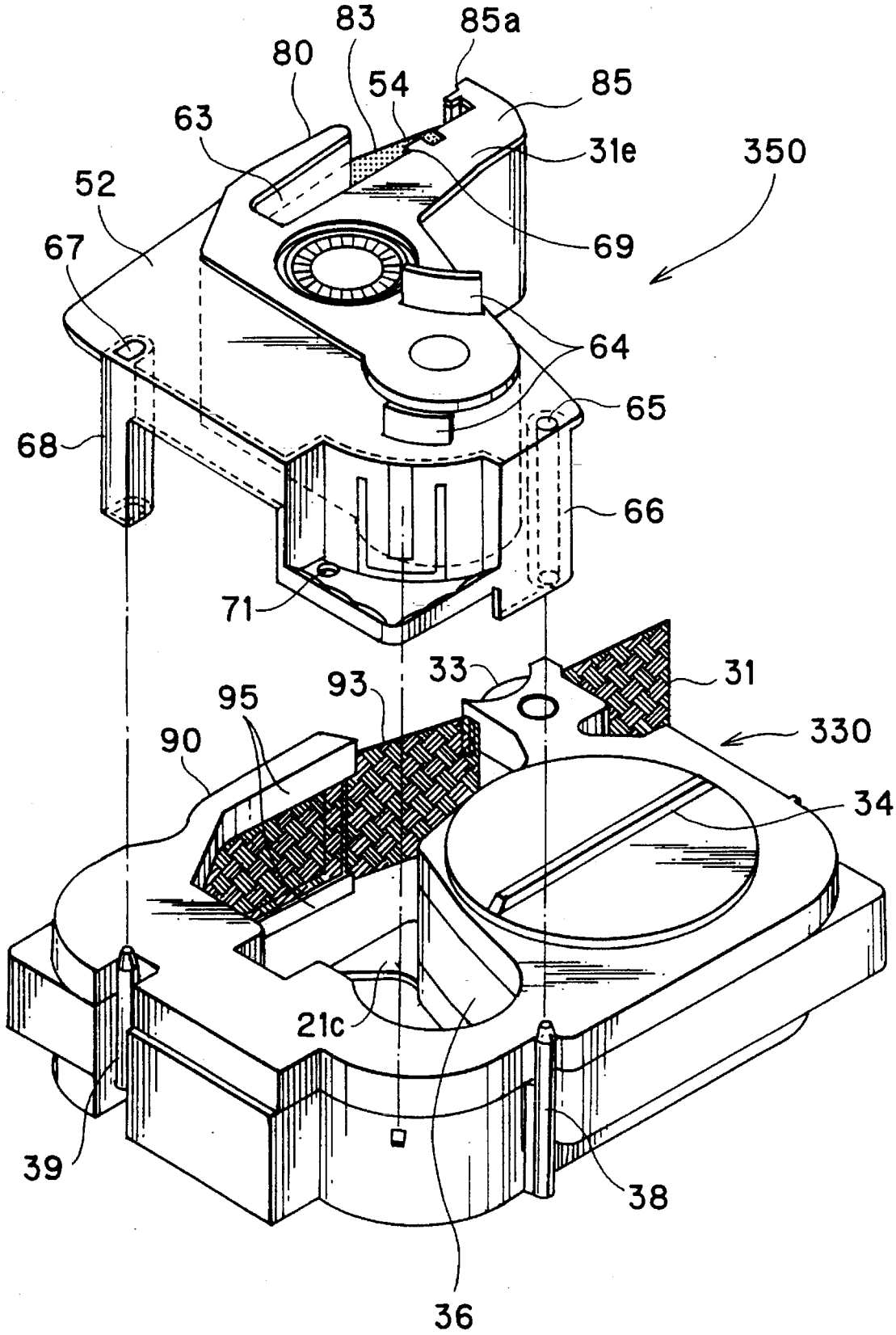
FIG. 14 is an exploded view showing the tape/ribbon composite cassette of FIG. 11.

As shown in FIGS. 13 and 15, a ribbon guide 90 for guiding the ink ribbon 54 to the thermal head 14 is formed to the ribbon cassette 50. The side of the ribbon guide 90 facing the head insertion portion 63 is open. A separation member 85 for housing the guide rod 59 and the ribbon guide 60 is provided integrally with the case of the ribbon cassette 50. The separation member 85 includes at its tip a separation portion 85*a* for preventing contact between the tape 31 and the ink ribbon 32 by separating the two by a distance.

As mentioned in the third embodiment, the ink ribbon 54 is exposed at a gap 83 defined by a ribbon exposure portion. In the fourth embodiment, the gap 83 is defined by the tip of the ribbon guide 80 and the separation portion 85*a*. Said differently, the gap 83 is downstream, with regards to the transport direction of the ink ribbon 54, from the ribbon guide 80 and upstream from the separation portion 85*a*.

The ink ribbon 54 exposed at the gap 83 and the tape 31 exposed at the gap 93 will be in abutment when in confrontation with the print head. Therefore, the tape can be printed on via the ink ribbon using the print head.

As shown in FIG. 10, the ink ribbon 54 wound around the ribbon spool 53 extends through an ink ribbon passage provided in the ribbon cassette 350 in parallel with and in the vicinity of the tape 31 where the ink ribbon 54 is in contact with the thermal head 14. When the ink ribbon 54 is heated by the print head 14, the ink on the ink ribbon 54 melts and clings to the confronting section of the print tape 31. The ink ribbon 54 is cleanly separated from the tape 31 and then taken up by the ribbon take-up spool 34.

Because the confronting portions of the tape guide and the ribbon guide are open, the tape and the ink ribbon can be transported by the print head close to each other and substantially in parallel with each other. Also, the separation members 95 insure that the tape and the ink ribbon will reach the print head without contacting each other. Therefore, the tape will not be unintentionally stained by contacting the ink ribbon.

Also, portions of the tape guide and the ribbon guide other than the confronting surfaces can be formed thick enough to provide sufficient structural support and to prevent their deformation even if the tape cassette 330 houses a wide tape 31, such as a 24 mm or 32 mm wide tape, and the ribbon cassette 350 houses a wide ink ribbon 54, such as a 24 mm or 32 mm wide ink ribbon.

Also, the die for casting the tape cassette and the ribbon cassette can be designed without taking into consideration the thickness dimension of the opposing walls, which if too thick would result in a large gap between the tape 31 and the ribbon 54 when in opposition with the print head 14 and if too thin would risk the tape cassette and ribbon cassette being structurally unstable. This makes the ribbon cassette 350 and the tape cassette 330 easier to produce.

It should be mentioned that in this embodiment another floor portion 21*c* is provided to the tape cassette 330 as shown in FIG. 12. The pair of floor portions 21*c*, 21*d* abut the lower surface of the ribbon cassette 50, further improving precision of positioning in the vertical direction.

While the invention has been described in detail with reference to specific embodiments thereof, it would be apparent to those skilled in the art that various changes and modifications may be made therein without departing from the spirit of the invention, the scope of which is defined by the attached claims.

For example, the above-described guide positioning mechanisms are only examples. Various modifications can be made to the positioning pins, the engagement holes, the positioning portion, the engagement portion, and the like, Also, the arrangement of the positioning pins, the engagement holes and the like is not limited to the above-described embodiments. For example, the rib-shaped guide portion 40 and the L-shaped guided portion 69 can be omitted or otherwise only two pairs of guide portions and guided portions be provided to the tape/ribbon composite cassette. However, to ensure precise guiding when mounting the ribbon cassette to the tape cassette and precise positioning of the ribbon cassette when it is mounted in the tape cassette, it is desirable to provide three pairs of guide portions and guided portions the tape/ribbon composite cassette. It is also desirable that one pair of guide portions and guided portions be provided near the head insertion portion.

Alternatively, the rib-shaped guide portion 40, the L-shaped guided portion 69, the pin-shaped guide portion 45, and the hole-shaped guided portion 75 can all be provided in the same tape/ribbon composite cassette. However, this might provide too tight a fit that would make mounting the ribbon cassette into the tape cassette difficult. It is therefore desirable to provide only one of either the rib-shaped guide portion 40 and the L-shaped guided portion 69 or the pin-shaped guide portion 45 and hole-shaped guided portion 75 to the same tape/ribbon composite cassette.

Figure 16:
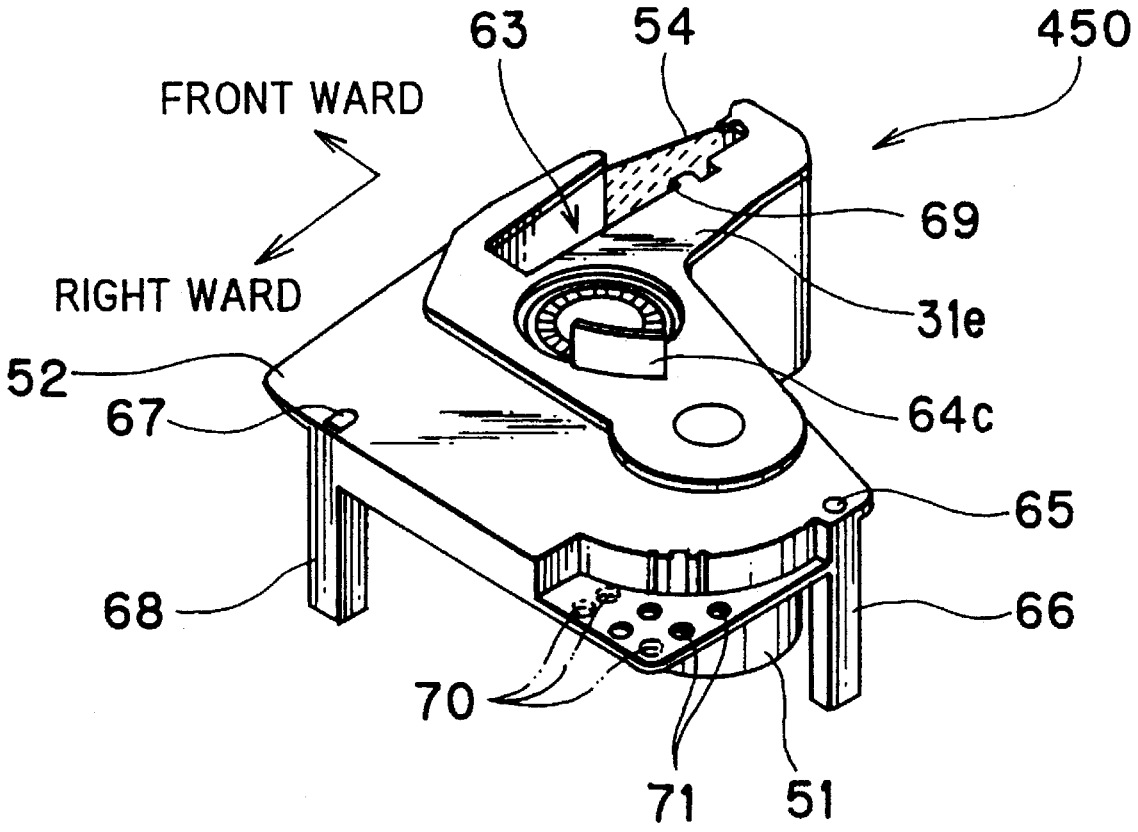
FIG. 16 is a perspective view showing a ribbon cassette with a single grip provided near a center of gravity of the ribbon cassette.

As shown in FIG. 16, a single grip 64*c* can be provided in place of the grips 64, 64*a*, and 64*b*. However, in this case it is desirable that the single grip 64*c* be formed near the center of gravity of the ribbon cassette 450. It should be noted that when two grips are provided, the ribbon cassette can be more stably grasped when grasping the ribbon cassette. Any grip or pair of grips described in any embodiment can be provided to any ribbon cassette of any other embodiment.

The positioning of the ribbon cassette pawls B1, B2, and the tape cassette pawls C1, C2, and C3 can be varied as needed.

Any feature described in a particular embodiment can be provided to any other embodiment.

What is claimed is:

1. A tape/ribbon composite cassette comprising a tape cassette freely detachably mounted in a printer provided with a print head, the tape cassette housing a tape serving as a print medium, the tape cassette having an upper surface;

a ribbon cassette freely detachably mounted in the tape cassette, the ribbon cassette housing an ink ribbon, the ribbon cassette provided with an upper surface overlapping at least a portion of the upper surface of the tape cassette;

at least two guide portions provided to the tape cassette at positions separated from each other at an outer periphery of the tape cassette, the at least two guide portions guiding the ribbon cassette vertically in and out of the tape cassette; and at least two guided portions formed integrally to the upper surface of the ribbon cassette at positions corresponding to the positions of the guide portions, the at least two guided portions engaging with the guide portions to guide the ribbon cassette vertically in an out of the tape cassette.

2. A tape/ribbon composite cassette as claimed in claim 1 wherein the at least two guide portions include three guide portions and the at least two guided portions include three guided portions.

3. A tape/ribbon composite cassette as claimed in claim 2 further comprising a pair of grips, for grasping the ribbon cassette, formed to the ribbon cassette so as to protrude above the upper surface.

4. A tape/ribbon composite cassette as claimed in claim 2 wherein the ribbon cassette and tape cassette include a head insertion portion into which the print head of the printer is disposed when the tape cassette and ribbon cassette are mounted to the printer, at least one corresponding pair of the three guide portions and the three guide portions being provided in the vicinity of the head insertion portion.

5. A tape/ribbon composite cassette as claimed in claim 4 wherein the at least one of the three guide portions provided in the vicinity of the head insertion portion secures the ribbon cassette in regards to the tape cassette in a direction in which a portion of the ink ribbon in confrontation with the head insertion portion is separated from a corresponding portion of the tape opposing an outer surface of the ink ribbon.

6. A tape/ribbon composite cassette as claimed in claim 4 wherein the at least one of the three guide portions provided in the vicinity of the head insertion portion secures the ribbon cassette in regards to the tape cassette in a direction perpendicular to a direction in which the ink ribbon and the tape are transported past the print head.

7. A tape/ribbon composite cassette as claimed in claim 4 wherein the at least one of the three guide portions provided in the vicinity of the head insertion portion is a pin formed to a floor portion of the tape cassette.

8. A tape/ribbon composite cassette as claimed in claim 4 wherein the at least one of the three guide portions provided in the vicinity of the head insertion portion is an upright rib-shaped member formed to a floor portion of the tape cassette, the rib-shaped member abutting a groove formed at a corresponding position in the ribbon cassette.

9. A tape/ribbon composite cassette as claimed in claim 1 further comprising at least one grip provided to the ribbon cassette so as to protrude above the upper surface.

10. A tape/ribbon composite cassette as claimed in claim 9 wherein the at least one grip is positioned between two of the at least two guided portions.

11. A tape/ribbon composite cassette as claimed in claim 9 wherein the at least one grip is positioned at a center of gravity of the ribbon cassette.

12. A tape/ribbon composite cassette as claimed in claim 9 wherein the at least one grip includes two grips disposed equidistance from a center of gravity of the ribbon cassette.

13. A tape/ribbon composite cassette as claimed in claim 12, wherein the at least two guide portions include three guide portions, wherein the at least two guided portions include three guided portions, and wherein the center of gravity of the ribbon cassette is defined by a triangle formed by the three guided portions.

14. A tape/ribbon composite cassette as claimed in claim 12 wherein one of the two grips is positioned between two of the at least two guided portions.

15. A tape/ribbon composite cassette as claimed in claim 1 further comprising:

a tape exposure portion provided to the tape cassette, the tape exposure portion formed with a gap at a position opposing the print head of the printer when the tape cassette is mounted in the printer, the tape housed in the tape cassette being exposed through the gap; and a head insertion portion provided to the ribbon cassette, the head insertion portion formed with an opening into which the print head is disposed when the tape/ribbon composite cassette is mounted in the printer, the head insertion portion being formed with a gap through which the ribbon is exposed in confrontation with the print head at one surface of the ribbon and in contact with an inner surface of the tape on an opposite surface of the ribbon.

16. A tape/ribbon composite cassette as claimed in claim 15 wherein the ribbon cassette and tape cassette include a head insertion portion into which the print head of the printer is disposed when the tape cassette and ribbon cassette are mounted to the printer, at least one corresponding pair of the three guide portions and the three guide portions being provided in the vicinity of the head insertion portion.

17. A tape/ribbon composite cassette as claimed in claim 15 further comprising a pair of grips, for grasping the ribbon cassette, formed to the ribbon cassette so as to protrude above the upper surface.

18. A tape/ribbon composite cassette as claimed in claim 15 further comprising:

a tape guide provided to an outer periphery of the tape cassette at a position upstream from the tape exposure portion in a direction in which the tape is fed, a side of the tape guide facing the ribbon cassette being open; and a ribbon guide provided to an outer periphery of the ribbon cassette at a position upstream from the gap of the head insertion portion in a direction in which the ribbon is fed, a side of the ribbon guide facing the tape cassette being open.

19. A tape/ribbon composite cassette as claimed in claim 18 further comprising:

a separation member for separating the tape and the ribbon from each other provided to an upstream tip of the tape exposure portion.

20. A tape/ribbon composite cassette as claimed in claim 19 further comprising a pair of grips, for grasping the ribbon cassette, formed to the ribbon cassette so as to protrude above the upper surface.

21. A tape/ribbon composite cassette as claimed in claim 18 further comprising:

a separation member for separating the tape and the ribbon from each other provided upstream from the gap of the head insertion portion.

22. A tape/ribbon composite cassette as claimed in claim 18 further comprising a separation member for separating the tape and the ribbon from each other provided to a downstream tip of the tape exposure portion.

* * * * *